US005417418A

United States Patent [19]

Terzaghi et al.

[11] Patent Number: 5,417,418

[45] Date of Patent: May 23, 1995

[54] MONOSHAFT COMPOSITE TENNIS RACQUET

[75] Inventors: André Terzaghi, Havertown; Stephen J. Davis, Washington Crossing, both of Pa.

[73] Assignee: Prince Manufacturing, Inc., Lawrenceville, N.J.

[21] Appl. No.: 988,579

[22] Filed: Dec. 10, 1992

[51] Int. Cl.[6] ..... A63B 49/02

[52] U.S. Cl. ..... 273/73 G; 273/73 R; 273/73 C

[58] Field of Search ..... 273/73 R, 73 C, 73 D, 273/73 F, 73 G, 73 H

[56] References Cited

U.S. PATENT DOCUMENTS

| | | | |
|---|---|---|---|
| Re. 31,419 | 10/1983 | Frolow . | |
| 3,999,756 | 12/1976 | Head | 273/73 D X |
| 4,007,929 | 2/1977 | Figa | 273/73 G X |
| 4,052,060 | 10/1977 | Balkcom | 273/73 G X |
| 4,575,084 | 3/1986 | Yoneyama | 273/73 G |
| 4,664,380 | 5/1987 | Kuebler | 273/73 G X |
| 4,989,871 | 2/1991 | Sheng | 273/73 G |
| 5,006,298 | 4/1991 | Tsai | 273/73 G X |
| 5,037,098 | 8/1991 | Davis | 273/73 C |
| 5,071,124 | 12/1991 | Davis | 273/73 G |
| 5,219,166 | 6/1993 | Chang | 273/73 G X |
| 5,238,247 | 8/1993 | Davis | 273/73 G |

OTHER PUBLICATIONS

Photocopy and side-view drawing, Völkl Soft Tennis Racket, 1981.

Tennis Magazine, Jul. 1980, Fischer Superform Mid tennis racquet.

Kuebler, "Zwangzig Jahre Tennisschläger", 1992, pp. 38–40, 42–43, 45–53, 55–57.

*Primary Examiner*—Raleigh W. Chiu

*Attorney, Agent, or Firm*—White & Case

[57] ABSTRACT

A monoshaft tennis racquet has a frame head that circumscribes a stringing area, and a shaft connected to the opposite ends of the head. Either the head or the shaft, and preferably both, are formed of a composite material. The racquet preferably has a head having a length of at least 12 inches, a maximum width of at least 9 inches, and a strung surface area of at least 90 square inches. Preferably also, the free space vibrational frequency perpendicular to the stringing plane is matched to the in-plane vibration frequency so as to provide a unique and desirable feel in the racquet. Preferably, the vibration frequency perpendicular to the stringing plane is within 10% of the in-plane vibration frequency, and most preferably within 5%.

17 Claims, 7 Drawing Sheets

FIG. 4
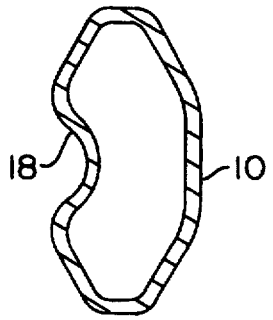
FIG. 5
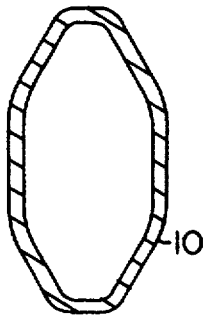
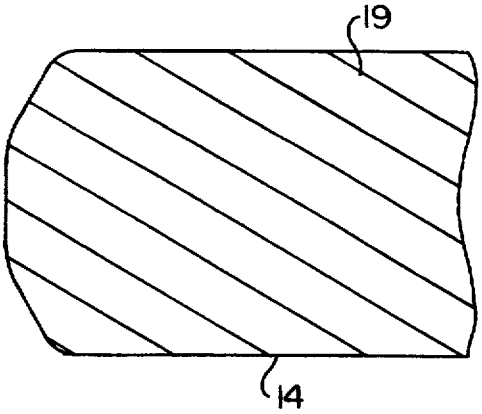
FIG. 6
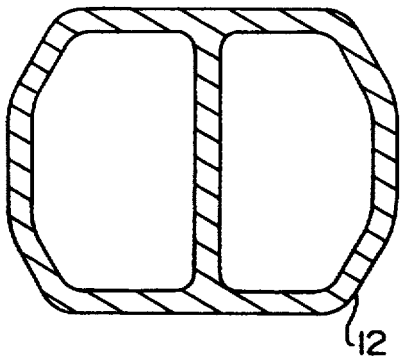
FIG. 7

MONOSHAFT COMPOSITE TENNIS RACQUET

FIELD OF INVENTION

The present invention relates to tennis racquets, and preferably tennis racquets in which the frame is made of fiber-reinforced resin, or so-called composite, material.

BACKGROUND OF THE INVENTION

Tennis racquets were traditionally constructed with a wood frame, usually ash. In early tennis racquets, the racquet was formed by bending a strip of ash (or a laminate formed of multiple strips of ash) into a hairpin shape, such that the middle portion of the strip formed an open stringing area. The ends of the strip converged in a throat region, and thereafter extended side-by-side to form a shaft. A generally triangular wood block was positioned in the throat region, between the opposite sides of the strip, to form the base of the stringing area.

In later wooden racquets, curved strips of ash extended across the throat area to form, with the remainder of the head portion, a generally oval shaped hoop defining the stringing area. Generally, a splice joint, wrapped by lengths of twine binding, was used to join the wood laminates in the throat area.

More recently, tennis racquets were introduced having hollow tubular metal racquet frames. Such racquets were formed by bending a single length of frame tube to form the head and shaft sections, the latter being formed by the ends of the tube, which converged in the throat and extended side-by-side to form the shaft. A separate throat piece was provided to span the throat area and complete the lower end of a generally oval stringing area. The throat piece was formed of metal or plastic and attached to the sides of the frame in various ways, such as welding, rivetting, or by screws. Such constructions are generally referred to as open throat racquets, in that the throat piece and converging frame sides defined an open area below the throat, located between the two shaft tubes. While metal frame racquets eventually became popular as an alternative to wood, they did not replace wooden racquets, and the two materials co-existed for some years.

In the 1970's, composites, in the form of fiber-reinforced thermosetting resins, were introduced as another frame material for tennis racquets. Initially, composites were not widely used as frame materials, however.

In about 1976, Prince Manufacturing, Inc. introduced the Prince ® Classic, in which the conventional geometry was changed to provide an oversize head, open throat tennis racquet, which greatly improved racquet performance. The Prince racquet, which is the subject of Howard Head U.S. Pat. No. 3,999,756, enjoyed immense popularity.

The Prince Classic racquet was made with an aluminum frame. In the 1980's, composites began to be increasingly used to make racquets utilizing the Howard Head design, i.e., open throat, large head racquets. Today, most tennis racquets utilize the large head geometry of the Howard Head invention (in sizes generally referred to as mid-size, mid-plus, or oversize) in an open throat design and utilize either composites or metal as the frame material.

In the conventional manufacturing process used today, sheets of uncured thermosetting resin, which contain carbon reinforcing fibers, a.k.a. "prepreg", are wrapped around a mandrel, which is then withdrawn to form a hollow tubular layup. A bladder is placed inside the tube and the tube, which at this point is flexible, is placed inside a mold in the shape of a racquet frame. A throat piece is also positioned in the mold, and additional resin material is wrapped around the joint between the throat piece and the frame tube. The mold is then closed and heated to cure the resin. At the same time, the bladder is inflated to force the tube to conform to the shape of the mold.

While almost all metal and composite racquets in the past have utilized the open throat design, composite racquets have been made in which the frame tubes join at the base of the stringing area, and then extend as a single shaft. Examples of such racquets are the PDP and Fischer Superform racquets, which were produced for a time in the 1970's.

The PDP and Fischer Superform racquets were of the pre-Howard Head design, i.e., only about 75 square inches in the head, were very heavy (on the order of 420 grams), and were also very bulky in the throat joint area. Racquets utilizing an open throat construction, in contrast, offered better aerodynamics (due to the fact that two thin frame members are used in the throat), better stability against torsional twisting, and a higher polar moment of inertia than the bulky throat designs of the PDP and Fischer racquets. As a result, the open throat design is almost universally employed in commercial racquets today.

There have also in the past been proposals for making tennis racquets in which the shaft is detachable from the head. However, such a racquet has never been commercially successful.

SUMMARY OF THE INVENTION

For the various reasons discussed above, single shaft tennis racquet designs have generally been considered less desirable, from a performance standpoint, than the open throat design, and have fallen into disuse. However, in accordance with the present invention it has surprisingly been found possible to make a monoshaft tennis racquet which produces numerous advantages over the corresponding open throat frame designs.

The present invention is a tennis racquet having a frame head that circumscribes an oversize stringing area, and a monoshaft extending from the head and supporting a racquet handle. In one embodiment, an elongated tubular frame member encloses a generally oval stringing area, and is bent sharply just prior to where the two opposed members meet to form a throat joint. From the throat joint, one or both of the frame members continue to form the shaft. In an alternative embodiment, the head portion and shaft are separate components, and are joined by a throat joint. Preferably, either the head or the shaft, and preferably both, are formed of a composite material. Alteratively, the head and/or shaft can be metal.

In accordance with one aspect of the invention, the tennis racquet frame has a standard overall length of about 26–28 inches, and an oversized head in accordance with the Howard Head invention. Preferably, the head portion of the frame circumscribes a stringing area having a length of at least 12 inches, a maximum width of at least 9 inches, and a strung surface area of at least 90 square inches.

In accordance with another aspect of the invention, a monoshaft tennis racquet has head and shaft frame portions such that the free space vibrational frequency perpendicular to the stringing plane is matched to the in-plane vibration frequency. Preferably, the vibration frequency perpendicular to the stringing plane is within 10% of the in-plane vibration frequency, and most preferably within 5%.

The present invention has been found to provide a number of advantages, which are discussed below.

Weight Reduction.

In the preferred embodiment, a monoshaft racquet is formed of a composite material to form a thin wall hollow frame. The monoshaft construction provides the ability to reduce the weight in the racquet by eliminating the throat bridge. Moreover, the present invention can be constructed so that the shaft is made of a single profile member, rather than a pair of side-by-side frame members as in open throat members, allowing a further reduction in weight. Even if additional composite material, e.g., 5 grams of reinforcement, is added to the throat joint, the monoshaft racquet may be made lighter than an equivalent open throat racquet by up to 20 grams. This is approximately 8% to 10% of the structural weight of the racquet. The full weight saving may be used to obtain a very light, maneuverable racquet with only a small sacrifice in some playability characteristics. Alternatively, to improve the playability of the racquet, additional material may be added back into selected areas of the frame, as discussed below, still producing a net weight savings, e.g., of 5 to 15 grams. The weight savings are independent of weight variations caused by different construction techniques.

Balance Point.

The center of mass of most racquets is within 50 mm of the center of the long axis of the racquet. The throat piece of most racquets also lies within the same range. Therefore, the weight reduction in the monoshaft racquet, which is reduced by reducing weight in the throat, is achieved without adversely affecting the balance point of the racquet. If, however, it is desired to change the balance point, material can be added back to other parts of the racquet. Thus, the monoshaft racquet makes it is possible to change the balance point while at the same time reducing the weight of a conventional racquet.

Static Moment.

This is the mass of the racquet multiplied by the distance from the butt to the balance point of the racquet. The static moment represents the torque at the hand felt by the player when he or she holds the racquet at the handle with the long axis horizontal, and accelerates the racquet in a straight line. Monoshaft racquets will have a lower static moment than an equivalent open throat racquet since the weight reductions occur away from the handle, thus requiring less effort to swing the racquet.

Mass Moment of Inertia.

There are two axes of importance for measuring the mass moment of inertia. The mass moment of inertia through the player's hand determines the swing weight felt by the player when applying angular acceleration to the racquet, such as in a "wristy" serve where the racquet's ratio of angular velocity to linear velocity is very high. A monoshaft racquet will have a lower mass moment of inertia than an equivalent open throat racquet due to the reduction in mass away from the butt end. If material is added to the head of the racquet, the mass moment of inertia of the monoshaft racquet will become closer to that of an open throat racquet.

The mass moment of inertia about the center of mass of the racquet is an important factor in the energy balance between the racquet's linear and angular kinetic energy and the ball's kinetic energy after impact between the racquet and the ball. Since the weight savings in monoshaft racquet occur near the center of mass, the reduction of the mass moment of inertial about the center of mass in negligible. If material is added to the racquet away from the center of mass, a desirable increase in the mass moment of inertia about the center of mass will occur. Thus, the monoshaft racquet makes it possible to increase the moment of inertia about the center of mass while retaining a weight and moment of inertia about the hand comparable to, or less than, a conventional racquet.

Polar Moment of Inertia.

The weight reduction in the throat of a monoshaft racquet occurs mainly at a small distance away from the central axis of the racquet. Therefore the polar moment is not significantly affected, but rather is slightly reduced, typically about 5%. However, by redistributing material to the sides of the head of the racquet, the polar moment can be increased to a value greater than is typical for an equivalent open throat racquet without increasing the overall weight of the racquet.

Center of Percussion.

The ratio of the mass of the racquet to the mass moment of inertia (the square of the radius of gyration) is higher for a monoshaft racquet than for an equivalent open throat racquet. Therefore the center of percussion is advantageously moved towards the tip of the frame.

Out of Plane Bending Stiffness.

Bending stiffness of all racquets is highly sensitive to details of frame cross-section geometry, and details of the construction used, such as the bias angles of the fibers in composite direction.

The only differences that occurs in out of plane bending (i.e., bending perpendicular to the stringing plane) is in how stresses are carried through the throat and shaft areas of the racquets. In monoshafts, there is a short portion of the head of the racquet on either side of the throat joint (where the head meets the shaft) where bending loads are carried mostly as torsion in the frame. In the shaft, bending loads are carried as pure bending. In contrast, an open throat racquet carries bending loads as coupled bending and torsion through the throat and shaft areas.

Preferably, according to the invention the layups used to make the racquet are modified, compared to conventional racquets, to achieve the desired torsional and stiffness characteristics. In the preferred embodiment of the invention, the bias angle of the carbon reinforcement fibers is increased in the head, adjacent the throat joint, in order to increase torsional stiffness to carry the out of plane bending loads.

In Plane Bending Stiffness.

Open throat racquets create a triangular bracing structure at the throat of the racquet which will give an open throat racquet better resistance to the deformation caused by stringing. However, this effect does not appear to cause any significant problems in monoshaft racquet.

Torsional Stiffness.

Torsional loads in open throat racquets are carried as coupled bending and torsion through the throat an shaft areas of the racquet. In contrast, torsional loads are carried as essentially pure torsion through the shaft of a monoshaft racquet. This effect makes it easy to vary the torsional stiffness of a monoshaft racquet independently of the bending stiffness, making the range of possible torsional stiffness wider for a monoshaft than an open throat racquet.

Aerodynamics.

The monoshaft racquet made with a relatively wide shaft would cause slightly more aerodynamic drag on a straight (normal to the stringing plane) swing than the two narrow, flared shafts of a open throat racquet. For most shots in play, however, the swing is highly angled in order to put spin on the ball. In an angled swing, the monoshaft would tend to have an aerodynamic cross section similar to each of the two shafts of an open throat racquet (particularly wide body frames), resulting in less drag on a monoshaft racquet than the equivalent open throat racquet. In tests to date, players have noticed significantly better aerodynamics when playing monoshaft racquet.

Power.

The power of a racquet that is available to a player depends upon the kind of swing used. The means used to date to measure the power of a racquet typically measure the ratio of the initial and rebound velocities of a ball shot of a stationary racquet.

This way of measuring power is particularly suitable for a stroke such as a volley where the racquet has a very low velocity before the impact. For these tests it has been clearly demonstrated that increasing the mass of the racquet increases the power of the racquet. These tests have all used racquets of similar mass distribution. To understand the effects of reducing mass in the throat of the racquet, we need to carefully consider the energy transfers that occur in a ball-racquet impact.

Energy losses in a ball-racquet impact occur in the ball, strings, linear rebound kinetic energy of the racquet, angular rebound kinetic energy of the racquet and frame vibrations in the racquet. The losses in the strings and the ball are effectively independent of the frame and need not be considered.

The linear rebound kinetic energy loss of the racquet decreases as the mass of the racquet increases, and is therefore higher for a monoshaft. To understand this, we need to start with the fact that linear momentum (mass times velocity) is conserved during an impact. Over the range of possible racquet mass we are considering, the rebound linear momentum of the racquet is nearly constant since the ratio of the racquet mass to the ball mass is large and the racquet mass variations are relatively small. Rebound velocity of the racquet is therefore inversely proportional to the mass of the racquet. Energy losses in the ball, strings and racquet vibration are close to constant for the two cases, so the energy balance between the ball and racquet is determined by their velocities and masses. Since the kinetic energy is $\frac{1}{2}$ mass times velocity squared, a small difference in the rebound velocity results in a proportionately larger difference in kinetic energy. Higher racquet mass therefore means lower racquet energy, and by conservation of energy, higher ball rebound energy and velocity.

The angular rebound kinetic energy loss of the racquet decreases as the mass moment of inertia about the center of mass increases for similar reasons as the linear kinetic energy, and increases as the distance from the point of impact to the center of mass increases. Since the position of the center of mass is similar for a monoshaft and the equivalent open throat racquet, the angular rebound kinetic energy loss is likely to be similar in a monoshaft racquet to that of an equivalent open throat racquet due to their similar mass moment of inertia about their center of mass. If material is redistributed in a monoshaft so that the mass moment of inertia increases, then the angular energy losses will be lower than for an open throat racquet.

Combining these effects, we see that all racquets have the lowest energy losses when impacted as near to the center of mass as possible. The energy loss increases as the impact location moves towards the tip of the racquet due to the increasing amount of angular kinetic energy being transferred to the racquet. Comparing a monoshaft with weight redistribution to an open throat racquet, we see that a monoshaft will have greater energy loss when impacted at the throat due to its lower mass. As the impact location moves towards the tip, however, the energy loss for an open throat increases more rapidly than for a monoshaft. Hence a monoshaft that redistributes some of the weight savings from the throat is likely to have higher power at the tip, and a more even distribution of power over the hitting area of the racquet.

The energy losses due to racquet vibrations are typically small in relation to the kinetic energy (linear and angular) losses, and are very sensitive to the location of the impact. A monoshaft will typically have higher fundamental natural frequencies of vibration than an equivalent open throat racquet, but this difference will be small. Both nodes of the fundamental mode of vibration of a monoshaft are moved away from the throat, resulting in the point where minimum vibrations are excited by the impact being moved towards the tip, and therefore less excitation of vibrations for shots made towards the tip of the racquet. Therefore, there will be little generalized difference between open throat and monoshaft racquets for frame vibration energy losses, but monoshafts appear likely to have lower vibration losses in typical use where players hit towards the tip of the racquet.

If some of the material saved is added back to a different part of the racquet, the increase in mass moment of inertia can more than compensate for the decrease in mass, resulting in increased power. Power variation over the face of a monoshaft racquet will be less than for the equivalent open throat racquet due to the higher value of the radius of gyration for the monoshaft. This results in an expanded power zone for the monoshaft relative to the equivalent open throat racquet.

Maneuverability.

The maneuverability of a tennis racquet is determined by a combination of the racquet's mass, static moment and mass moment of inertia about the axis through the player's hand. Since all of these parameters for a monoshaft are lower than or equal to those of an equivalent open throat racquet, a monoshaft racquet will have increased maneuverability. The improved aerodynamics of the monoshaft for many shots will also improve maneuverability relative to the equivalent open throat racquet.

Torsional Stability.

The polar moment of inertia is the main physical parameter affecting torsional stability, with torsional stiffness affecting the player's feel of an off-axis impact. If the full potential weight savings are used in a monoshaft, then it will have a slightly lower torsional stability than an equivalent open throat racquet. Since both the polar moment of inertia and the torsional stiffness can be easily varied in a monoshaft, the torsional stability of a monoshaft can be made equal to or better than an equivalent open throat racquet by adding a portion of the weight savings back to the sides of the head, while still retaining some of the weight savings.

Vibration Modes Normal to the String Plane:

Natural Frequencies.

A monoshaft racquet will tend to be higher in frequency for mode shapes that have antinodes near the throat (e.g., the fundamental frequency of free space vibration) than the equivalent open throat racquet. This is due to the reduction in mass near an antinode of vibration. This effect is most pronounced in the lower order modes of vibration, and is true whether material is redistributed or not. However, in practice the difference is small.

Node Locations.

The nodes of the first bending mode of vibration in a monoshaft racquet tend to be further away from the center of mass than in an open throat racquet. This is due to the fact that, because the instantaneous center of mass of the vibrating racquet does not move during pure vibration, the reduction in mass at the central antinode area of the racquet causes the nodes to move towards the extremities of the racquet.

"Torsional" antisymmetric modes appear to be confined to the head of monoshaft racquets, rather than extending down the shafts and handle as appears to occur with open throat racquets. This means that the entire handle is effectively a node for these modes of vibration, isolating the head vibrationally from the shaft and handle.

In Plane Modes of Vibration:

Natural Frequencies.

Monoshaft racquets are lower in natural frequency for in plane bending modes than the equivalent open throat racquet. The triangle structure of the throat of an open throat racquet is enormously stiff, allowing effectively zero in plane bending to occur in the throat and shafts. In the preferred monoshaft racquet, the first in plane bending mode (which could be excited by a heavy top spin or slice shot) is nearly the same frequency as the first normal bending mode. In a conventional racquet, the first in plane mode has a significantly higher frequency than the first normal bending mode. The second in plane bending mode, which is mostly confined to the hoop of the monoshaft racquet, is also significantly lower in frequency for the monoshaft racquets tested.

Node Locations.

On every racquet tested, monoshaft and open throat, the handle node location is nearly the same for the first in plane mode and the first normal mode. This handle node location is further towards the butt end on a monoshaft than in the equivalent open throat racquet. In all racquets, the location of this node is primarily determined by the mass distribution of the racquet, with the stiffness distribution having a very small secondary effect. In higher order modes on open throat racquets there tend to be nodes at the corners of the throat triangle. On the monoshaft racquets, there does not appear to be a similar clustering of nodes at the intersection of the shaft and head.

"Feel" of the Racquet.

Matching and fundamental frequencies (to within about 10%) for in plane and out of plane vibrations appear to add a desirable component to the feel of a racquet.

The vibrations caused in play typically damp out within 10 cycles due to the hand. If the frequencies of the two modes are close, the net displacement, velocity and acceleration vectors of the combined vibrations remain fairly well in phase during the entire time of the vibration. Since the vibrations are excited by the same input, they will lie approximately in a plane at the handle of the racquet at the start of vibration. This plane is inclined at some angle to the string plane, the angle determined by the relative amplitudes of the normal and transverse vibrations. If the vibrations remain exactly in phase, all the vectors will remain in the plane.

If the frequencies are different, then large phase differences between the two vibrations will occur early in the vibration when amplitudes are still large, causing the displacement, velocity and acceleration vectors to move out of their initial plane.

We believe that the way the vibration retains its directional information when the frequencies are closely matched, as in the preferred embodiment of the monoshaft racquet, gives improved feedback to the player. Vibrations that retain their directionality give a stronger, longer lasting coherent signal to the player about the direction of the forces applied to the ball, allowing better feel of the spin and direction of the ball rebound.

The unique feel of the monoshaft racquet is not fully understood. We believe that the confinement of torsional and some other vibration modes to the head of the monoshaft racquet contributes to its unique feel relative to open throat racquets where the equivalent modes extend into the handle.

For a better understanding of the invention, reference is made to the following detailed description of a preferred embodiment, taken in conjunction with the drawings accompanying the application.

BRIEF DESCRIPTION OF THE DRAWINGS

FIG. 4 is a cross-sectional view of the racquet frame, taken through lines 4—4 of FIG. 1;

FIG. 5 is a cross-sectional view of the racquet frame, taken just above the throat joint, through lines 5—5 of FIG. 3;

FIG. 6 is a sectional view of the throat joint, taken through lines 6—6 of FIG. 3;

FIG. 7 is a cross-sectional view of the shaft, taken through lines 7—7 of FIG. 3;

DETAILED DESCRIPTION OF PREFERRED EMBODIMENTS

Figure 1:
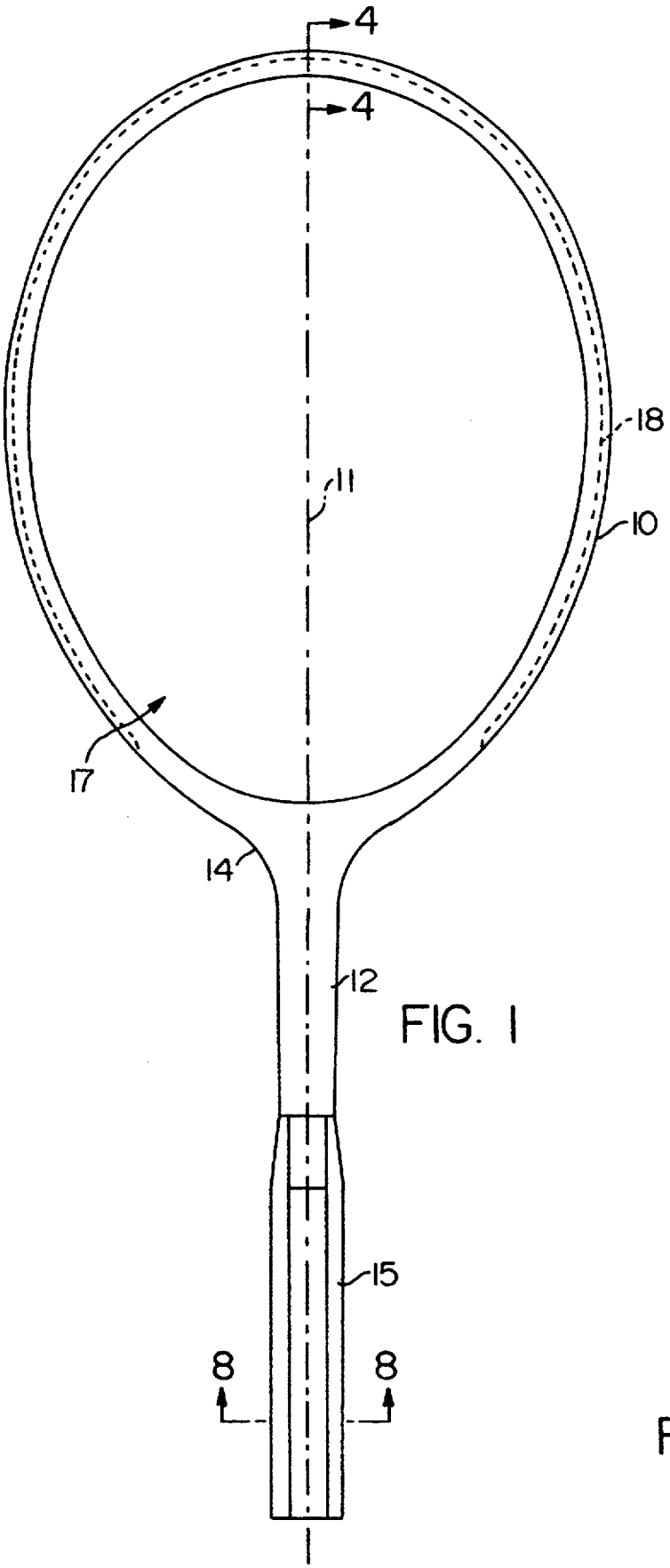
FIGS. 1 and 2 are front and side views, respectively, of a monoshaft tennis racquet frame according to the invention.
Figure 2:
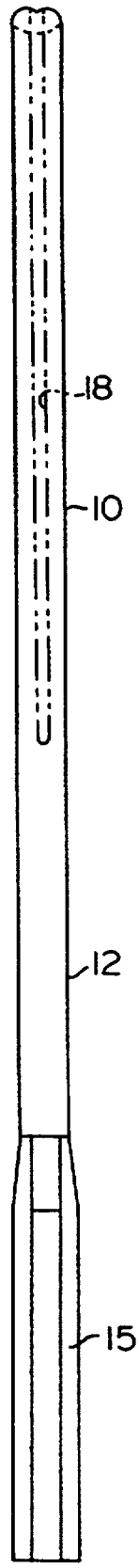

Referring to FIGS. 1–2, a monoshaft frame according to the invention includes a head 10 and a shaft 12, which are connected together at a throat joint 14. The shaft includes a handle section 15. In the exemplary embodiment of FIGS. 1–2, the handle section 15 is molded directly into the shape of an octagonal handle, in accordance with known techniques. Alternatively, however, handle section 15 can be shaped to receive a conventional handle, or a slide-on cushioned pallet, as disclosed in commonly owned U.S. Pat. No. 5,034,082 and U.S. patent application No. 07/373,331. Also, a stringing groove 18 is formed in the outwardly facing surface in the conventional manner.

The head 10 and shaft 12 may be formed as either separate layups or as one, continuous frame member, as described further below. Preferably, the head and shaft are in the form of hollow tubular members, preferably formed of a fiber-reinforced material. Examples of suitable materials include carbon fiber-reinforced thermoplastic resin, or so-called "graphite", or a fiber-reinforced thermoplastic resin such as disclosed in commonly owned U.S. application No. 07/645,255. Alternatively, however, the head 10, shaft 12, or both may be formed of metal.

In the exemplary embodiment shown in FIGS. 1 and 2, the head 10 and shaft 12 have a constant cross-sectional height (in a direction perpendicular to the stringing plane). However, the height of the two members can be varied as desired. Also, while the head 10 and shaft 12 each are shown with straight profiles, i.e., constant height, varied profiles may be employed. For example, the head 10 and/or shaft 12 may be given a constant taper profile such as disclosed in commonly owned U.S. Pat. No. 5,037,098. Alternatively, the shaft may be given a non-uniform profile.

As shown, the cross-sectional width (direction in the stringing plane) of the head is less than the shaft, and the width of the shaft is slightly tapered toward the handle. However, the widths may be varied as desired.

As shown in FIGS. 4 and 7, the head 10 and shaft 12 of the frame are formed of hollow profile members of, e.g., molded composite material. Except in the throat joint, which as described below preferably has reinforcement material, the profile members have a wall thickness preferably of less than 2 mm, and most preferably of about 1.5 mm.

In the exemplary embodiment of FIGS. 1–8, the frame has an overall length of about 27 inches (680 mm). The head 10 defines a generally oval stringing area 17 with an axial length of about 13.3 inches (340 mm), a maximum width of 10.3 inches (260 mm), and a stringing area of about 107 square inches. The strung weight of the racquet is preferably about 280–300 grams, in view of the present day preference for light racquets. The racquet can be made lighter or heavier, however, as desired. While the weight savings resultant from the monoshaft geometry has allowed prototypes to have been made as light as about 235 grams, as described herein, it may be preferable to use such weight savings to add weight to other portions of the frame. The head 10 and shaft 12 have a constant cross-sectional height of about 0.9 inches (22 mm). The shaft 12 has cross-sectional shape as shown in FIG. 6, with a cross-sectional width which tapers from 1⅛ inches (28.4 mm) at the bottom of the throat joint 14 to about 1 inch (25 mm) just above the handle section 15.

Figure 3:
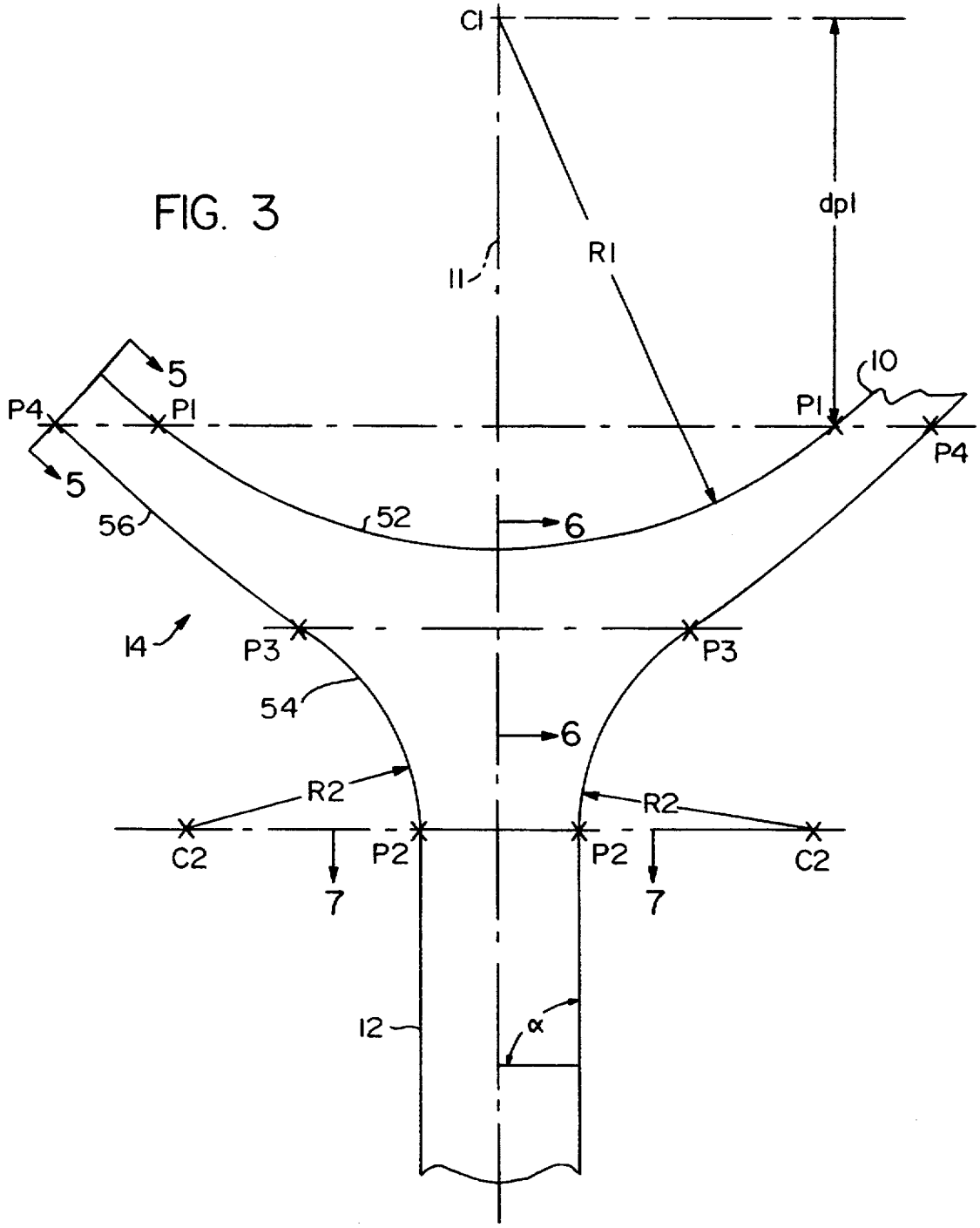
FIG. 3 is a front view, on a full scale, of the throat joint of a preferred embodiment of the invention.
Figure 8:
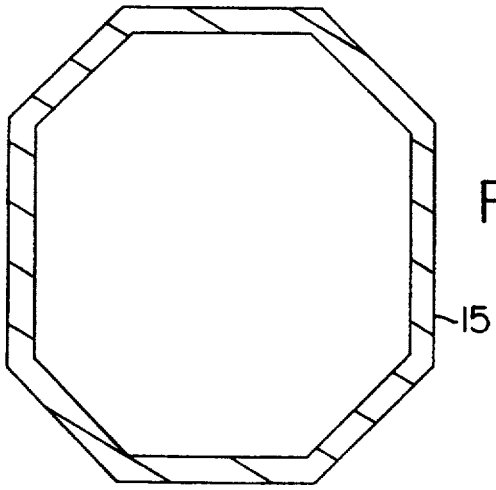
FIG. 8 is a cross-sectional view of the handle, taken through lines 8—8 of FIG. 1.

An example of a throat joint 14 is shown in greater detail in FIG. 3. The inner frame surface 52 is defined by an arc having a radius R1 about a center C1 lying on the racquet axis 11. In the embodiment shown, the radius R1 is 91.4 mm, and the inner frame surface 52 extends between points P1 that lie on opposite sides of the axis 11 at an axial distance "$d_{P1}$" of 69 mm from the center C1.

The outer surface of the joint 14 is formed of a shaft transition region 54, adjoining the upper end of the shaft 12, and a head transition region 56, adjoining the opposite ends of the head 10. The shaft transition region 54 begins at points P2, as an extension of shaft 12, and thus points P2 are spaced apart the width of the shaft (preferably 28.4 mm). The points P2 lie at an axial distance of 138 mm from center C1. The shaft transition region 54 is defined by an arc having a radius R2 about a center C2, which lies at the same axial distance as points P2. In the embodiment shown, the radius R2 is 40 mm, and the shaft transition region extends to points P3, lying at an axial distance of 103 mm from center C1. In the head transition region 56, the outer surface of the joint follows a curve, such that the cross-sectional width decreases until, at point P4, the width is the same as the head portion 10.

The head 10 may have conventional dimensions. In the exemplary embodiment, the head 10 has a cross sectional height of 22 mm and a maximum cross sectional width (dimension in the plane of stringing) of about 10.75 mm, or roughly a 2/1 ratio. Except for the fact that the head 10 becomes very slightly wider below the stringing groove, this geometry is maintained until the throat joint 14, or point P4 in FIG. 3.

As also shown in FIG. 3, preferably the sides of the shaft are slightly tapered, at angle $\alpha$, from the throat joint 14 to the handle portion 15. In the exemplary embodiment, $\alpha$ is 90.1°, and the cross sectional width of the shaft decreases from 28.4 mm at the throat joint 15 (the point P2—P2) to 25 mm at the top of the handle portion 15, while the cross sectional height remains constant.

The throat joint 14 may be formed in several ways, as described further on.

Figure 9:
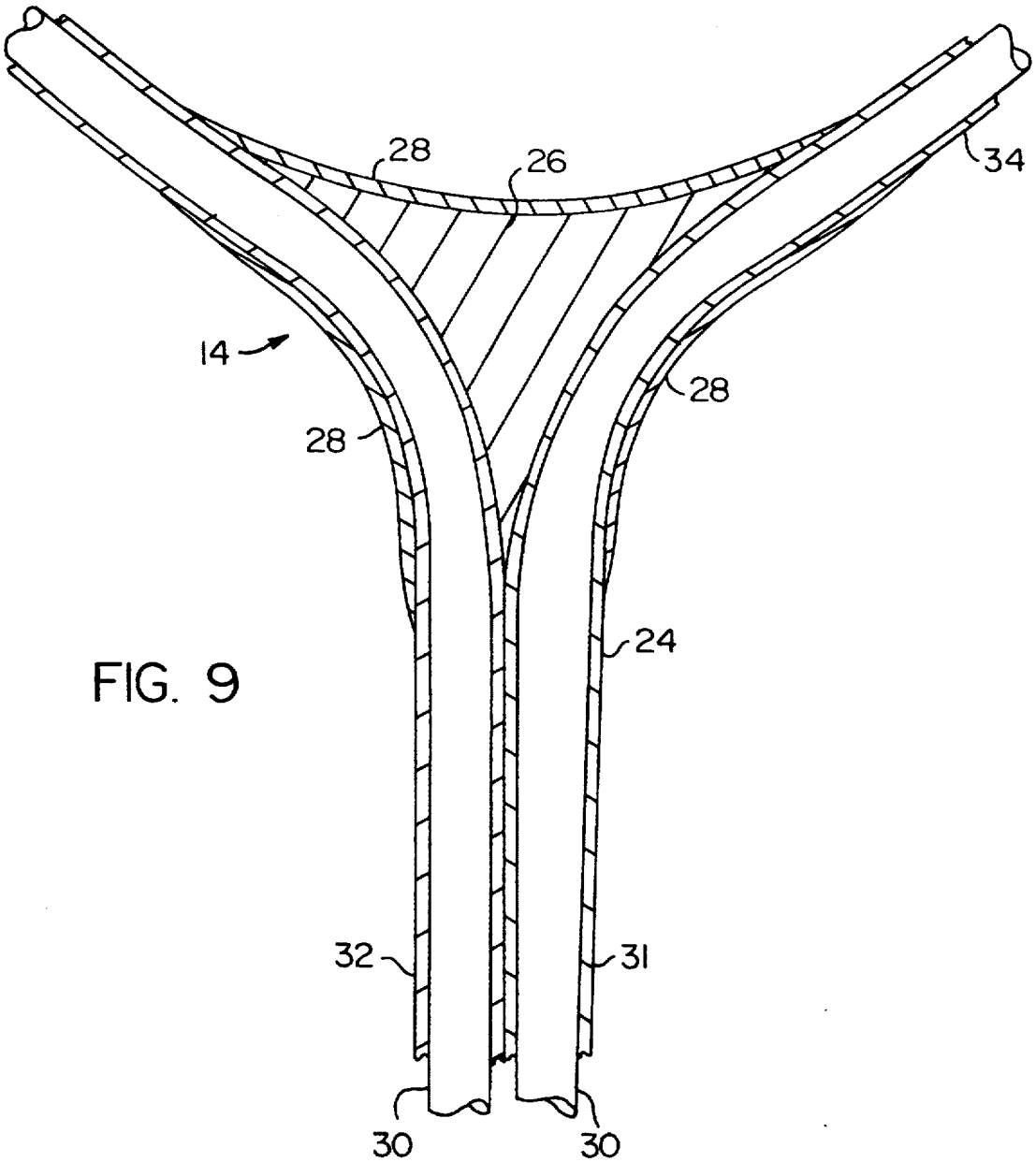
FIG. 9 is a front, sectional view of a layup of the throat region, prior to molding, of the racquet of FIG. 1.

In the embodiment shown in FIG. 9, a tubular layup 24 is formed of sheets of uncured fiber-reinforced, thermosetting resin (prepreg) in the normal manner. The tube is packed into a mold in the shape of FIGS. 1–2. Additional uncured composite material 26 is packed in the throat area 14, and the throat joint 14 is wrapped by additional sheets of prepreg 28. A bladder 30 is directed up through one side 31 of the shaft layup, around the head layup 34, and then back down through the other side 32 of the shaft layup, such that the two ends of the bladder extend out the bottom of the shaft. Once the layup 24 has been packed into the mold, the mold is closed and heated, and the bladder is inflated to conform the layup to the shape of the mold while the resin cures and hardens.

Figure 11:
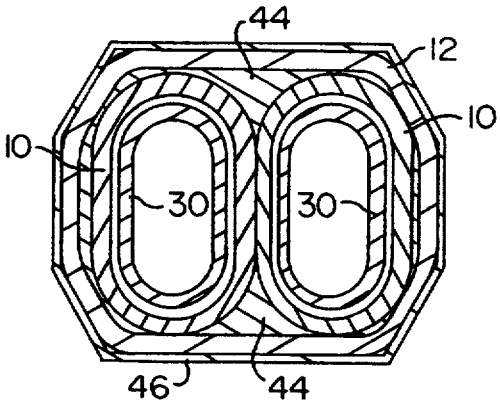
FIG. 11 is a cross sectional view of the layup of FIG. 10, taken through lines 11—11.
Figure 12:
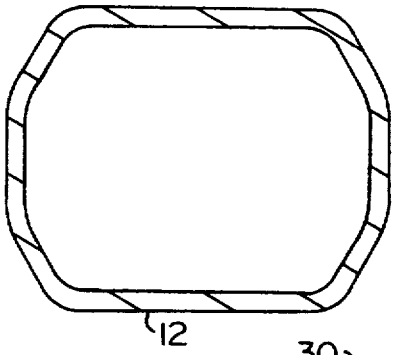
FIG. 12 is a cross sectional view of the shaft of the embodiment of FIG. 10, taken through lines 12—12.
Figure 10:
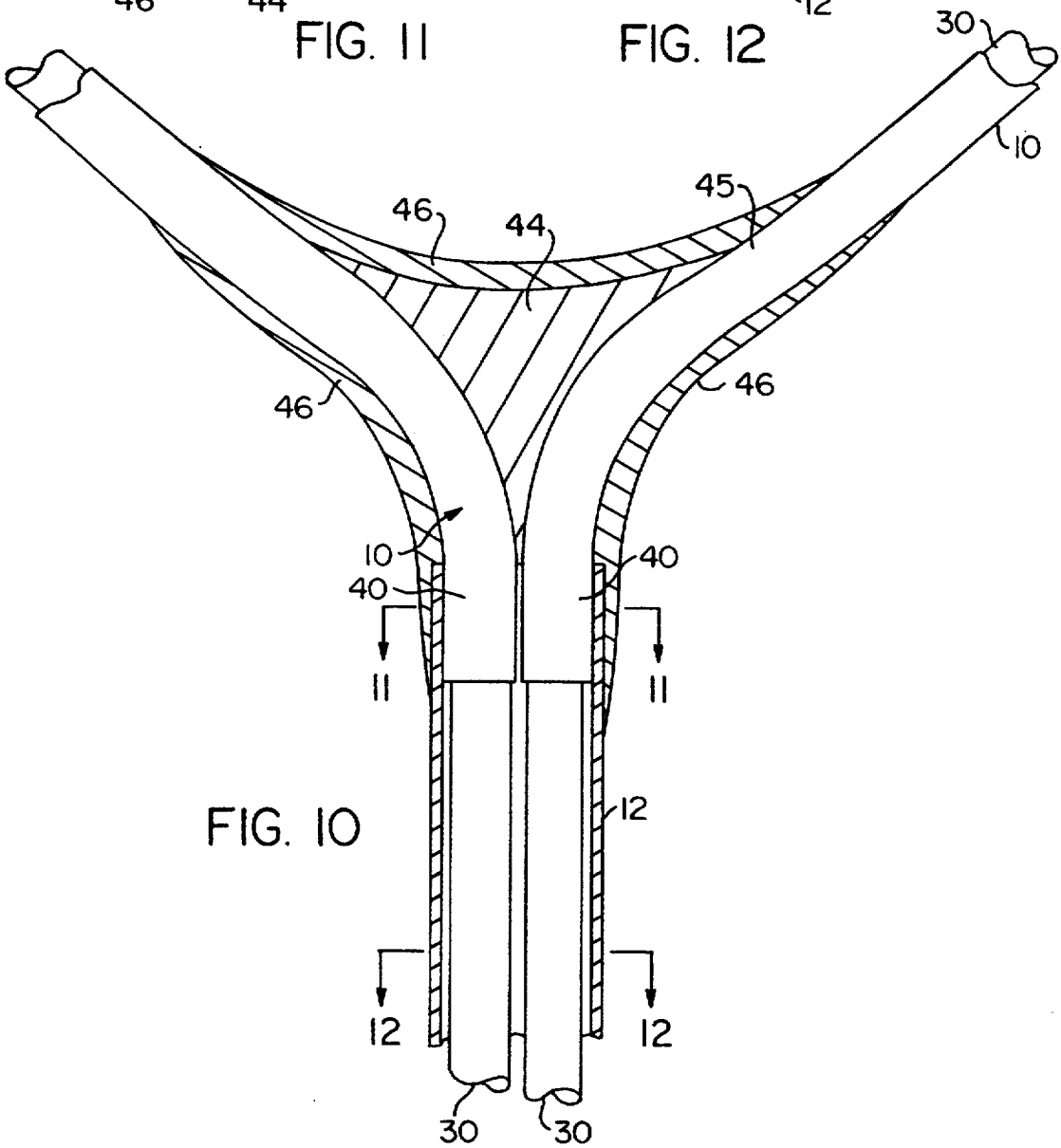
FIG. 10 is a front, sectional view of a layup of the throat region, prior to molding, of a second embodiment of the invention.

FIG. 10 illustrates an alternative embodiment in which the head 10 and shaft 12 are separate elements. In this case, the head 10 and shaft 12 may be provided either as pre-formed components, or as prepreg layups. In the case of the shaft 12, a single hollow tubular shaft may be utilized, as shown in FIG. 11. Moreover, the head 10 and shaft 12 be either the same material or different materials.

As shown in FIG. 10, the two opposite ends 40 of the head 10 are bent so as to extend side-by-side for a distance along the center axis of the head 10. The ends 40 of the head 10 are inserted into the upper end of the shaft 12. A bladder 30 is directed up through the shaft 12, around the head 10, and back down through the shaft 12, so that the two ends of the bladder extend out the bottom of the shaft, in the same manner as FIG. 9. Thereafter, as shown in FIGS. 10 and 11, additional uncured resin 44 may be provided in the throat joint area, and the throat joint 14 is wrapped by additional prepreg sheets 46.

As shown for example in FIG. 10, the throat joint 14 includes a relatively sharp bend between the shaft 12 and head 10. As a result, the initial section 45 of head 10 extends at about an angle of about 125° relative to the shaft axis 11. Moving up the head 10, this angle becomes less. However, over its initial length, the head 10 profile members carry out of plane bending loads mostly as torsion. As a result, in a preferred embodiment of the invention, the bias angle of the fibers in the prepreg used to form frame section 45, and for a desired additional distance along the head 10, is increased in order to improve the torsional stiffness of the initial portion of the frame. Additionally, or alternatively, the reinforcement 46 is wrapped such that the reinforcement fibers are at a bias angle to increase torsional stiffness.

The head 10 and shaft 12 may be preformed components, or alternately can be uncured materials. The head and shaft may be made either of metal or composite materials. The shaft may be advantageously made by pullforming. Where the head and shaft are uncured materials, the entire layup is placed in a mold and heated and cured, as in the case of FIG. 9. Where the head and shaft are metal or otherwise preformed components, it is necessary to mold and cure only the throat joint area to complete the frame.

Either of the foregoing techniques may be utilized where the head, or shaft or both are metal. In the case of FIG. 9, the metal tube is bent to form the frame, shaft, and sharp bend in the throat. Composite prepreg (or thermoplastic material, as described further on) is used as reinforcement 26 and an outer wrap 28. Where a metal head is to be joined to a composite shaft, or vice-versa, the technique of FIG. 10 is employed.

A racquet may be made using a thermoplastic material. Instead of forming the layups of thermosetting resins, sleeves of braided reinforcement fiber and thermoplastic filaments are utilized for each of the head and shaft members as disclosed in U.S. patent application No. 645,255, filed Jan. 24, 1991. Additional commingled fiber/filament material is used as reinforcement 26, 44 and as a wrap 28, 46 for the throat joint 14.

Figure 13:
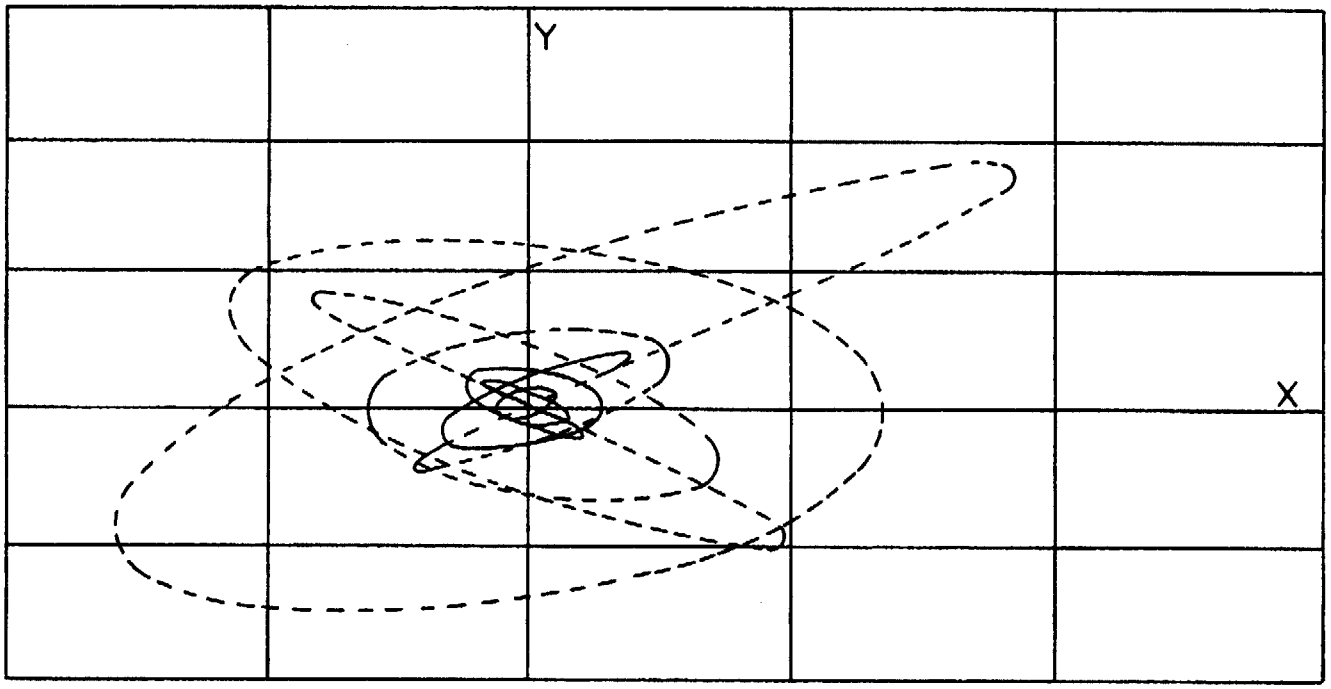
FIG. 13 is a theoretical plot of the displacement of the racquet handle of a conventional, open throat racquet responsive to a 45° ball impact on the strings.
Figure 14:
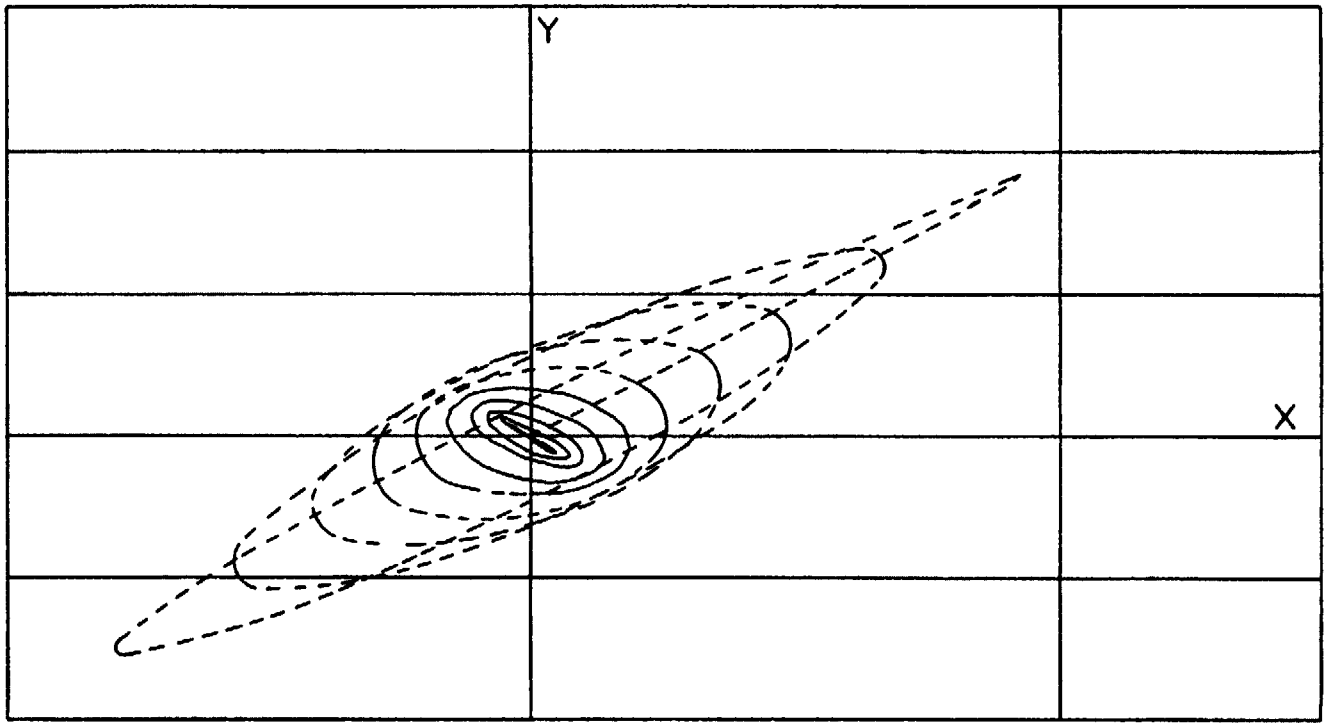
FIG. 14 is a theoretical plot of the displacement of a racquet handle according to the invention when excited in a manner similar to the racquet of FIG. 12.

FIGS. 13 and 14 are theoretical plots of the vibration displacement paths of a handle end of a conventional racquet compared to a racquet according to the invention, when excited by an initial ball impact, and are essentially decaying Lissajous figures. In each case, the starting point, prior to impact, is at the junction of the X-Y axis.

In these figures, the X and Y displacements represent the in-plane and out of plane vibration displacements. The plots show the X-Y position traced out over the time (approximately 1/10 second) of the vibration by a point on the racquet handle relative to its at rest position, where:

$$x(t)=A \sin(\omega_x t).exp(\alpha t)$$

and $$y(t)=A \sin(\omega_y t).exp(\alpha t)$$

where $\omega_x$ and $\omega_y$ are the in plane and out of plane frequencies of vibration, $\alpha$ is the decay constant of the vibration, and t is time.

As shown, the handle of a conventional racquet, when struck, follows a rapidly gyrating orbit as the vibration decays. In contrast, the handle of a racquet according to the invention, which in the exemplary racquet has in-plane and out of plane frequencies within 5% of one another, follows a more regular orbit, and remains within a small envelope around the original vibration direction.

In player tests, racquets according to the invention, in which the in plane and out of plane frequencies were matched, exhibited a unique and desirable feel. While the reasons why the racquets were so favorably received is not yet fully understood, it appears that the vibration response may be largely responsible. Thus, the directional information when the frequencies are closely matched gives improved feedback to the player. Vibrations that retain their directionality give a stronger, longer lasting coherent signal to the player about the direction of the force applied to the ball, allowing better feel of the spin and direction of the ball rebound. Thus, there is a more consistent flex regardless of whether the ball is hit straight or at an angle.

The vibrations caused in play typically damp out within 10 cycles. If the frequencies of the in-plane and out of plane vibrations are matched, the net displacement, velocity and acceleration vectors of the combined vibrations remain fairly well in phase during the entire time of the vibration, as shown in FIG. 14. Since the vibrations are excited by the same input, they will lie approximately in a plane at the handle of the racquet at the start of vibration. This plane is inclined at an angle to the string plane, determined by the relative amplitudes of the normal and transverse vibrations. If the vibrations remain exactly in phase, all the vectors will remain in the plane.

In contrast, as shown in FIG. 13, if the frequencies are different, then large phase differences between the two vibrations will occur early in the vibration when amplitudes are still large, causing the displacement, velocity and acceleration vectors to move out of their initial plane.

Due to the fact that the racquet has a monoshaft construction, it is possible to adjust the vibration frequency of in plane vibrations substantially independently of out of plane vibrations to produce the desired racquet feel. Moreover, due to the monoshaft construction, and the fact that the shaft can be configured independent of the head, it is possible to adjust a number of other parameters, and to achieve a number of other advantages, compared to an open throat design composite racquet.

As discussed above, due to the use of a monoshaft, it is possible to reduce the weight of the racquet up to about 20 grams compared to an open throat racquet of the same head size and materials.

The reduction of weight in the throat will increase maneuverability, but have little effect on the polar moment of inertia, such that the racquet will retain good stability. If the swing weight is increased by adding weight to, e.g., the 10 and 2 o'clock positions, the polar moment of inertial will increase, thus improving stability.

It is also contemplated within the invention that the bending and torsional stiffness of the head and shaft can be independently adjusted by changing the bias angles of the reinforcement fibers used in the two components.

The foregoing represents a preferred embodiment of the invention. Variations and modifications will be apparent to persons skilled in the art, without departing from the inventive concepts disclosed herein. All such modifications and variations are intended to be within the skill of the art, as defined in the following claims.

I claim:

1. A monoshaft tennis racquet comprising a frame having a standard overall length of at least about 26 inches, said frame including a tubular head having opposite ends and circumscribing a generally oval stringing area having a length of at least 12 inches, a width of at least 9 inches, and a strung surface area of at least 90 square inches; a throat joint at which said opposite ends substantially meet and which completes said generally oval stringing area; and a shaft, formed of at least one tubular member and supporting a handle, and having an upper end extending from said throat joint along an axis; wherein said throat joint includes a moldable, hardenable, reinforcement material; wherein the interiors of said opposite ends of said head and said at least one tubular member of said shaft are coextensive such that the region of said throat joint is substantially hollow and lightweight; wherein the throat joint includes a shaft transition region adjoining the upper end of the shaft, and a head transition region adjoining the opposite ends of the head; wherein the shaft transition region has opposing sides, each defined by an arc R2 having a center C2 located perpendicular to the axis; wherein arc R2 has a radius less than 50 mm; and wherein the opposite ends of the head enter the throat joint at an angle of less than 130° relative to the racquet axis such that the vibrational modes of the head are substantially independent of the vibrational modes of the shaft.

2. A tennis racquet according to claim 1, wherein said head and shaft are formed of a continuous tubular member.

3. A tennis racquet according to claim 1, wherein said head and shaft are separate components, wherein said shaft comprises a single tubular member, wherein said ends of said head extend a predetermined distance inside the upper end of said shaft and are bonded to said shaft, and wherein said reinforcement material surrounds a region where the upper end of said shaft and said ends meet.

4. A tennis racquet according to claim 1, wherein the opposite ends of the head enter the throat joint at an angle of about 125° relative to the racquet axis.

5. A tennis racquet according to claim 1, wherein the head and shaft have different cross sectional heights.

6. A tennis racquet according to claim 1, wherein the head and shaft are made of different materials.

7. A tennis racquet according to claim 1, wherein said shaft has a variable cross sectional width and height which are greatest at an axial location spaced from the handle.

8. A tennis racquet according to claim 1, wherein the head has a cross sectional height-to-width ratio of about 2/1.

9. A tennis racquet according to claim 1, wherein said head and shaft are formed of a tubular, composite material having a wall thickness of less than 2 mm.

10. A tennis racquet according to claim 9, wherein the frame has a weight under about 300 grams.

11. A tennis racquet according to claim 9, wherein the frame has a stringing area greater than 100 square inches.

12. A tennis racquet according to claim 9, wherein the head and shaft have a cross sectional height of about 22 mm.

13. A tennis racquet according to claim 9, wherein the shaft has a across sectional width in the range of about 1 inch to 1⅛ inches.

14. A tennis racquet according to claim 1, wherein said throat joint defines an inner frame surface having a radius R1 about a center C1 lying on said axis; wherein said radius R1 is less than 50 mm; and wherein the center C2 lies at an axial distance of less than 150 mm from center C1.

15. A tennis racquet according to claim 1, wherein said head is a tubular profile formed of composite material having substantially parallel reinforcing fibers, wherein said fibers are oriented at a bias angle relative to the tubular profile, and wherein said bias angle is greater above the throat joint than in the remaining portion of said head.

16. A tennis racquet comprising a frame, said frame including: a head circumscribing a stringing area; and a shaft supporting a handle extending from said head; wherein said racquet further includes stringing disposed in said stringing area and lying generally in a plane; wherein at least one of said head and said shaft are formed of a tubular composite material; wherein said frame is constructed to have a free space frequency of vibration perpendicular to the stringing plane which is matched to the in-plane vibration frequency; and wherein said shaft is a monoshaft.

17. A racquet according to claim 16, wherein the vibration frequency perpendicular to the stringing plane is within 10% of the in-plane vibration frequency.

* * * * *